US008855330B2

(12) United States Patent
Taenzer

(10) Patent No.: US 8,855,330 B2
(45) Date of Patent: Oct. 7, 2014

(54) AUTOMATED SENSOR SIGNAL MATCHING

(75) Inventor: Jon C. Taenzer, Los Altos, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1467 days.

(21) Appl. No.: 12/196,258

(22) Filed: Aug. 21, 2008

(65) Prior Publication Data

US 2009/0136057 A1 May 28, 2009

Related U.S. Application Data

(60) Provisional application No. 60/965,922, filed on Aug. 22, 2007.

(51) Int. Cl.

| | |
|---|---|
| ***H04R 1/10*** | (2006.01) |
| ***H04R 3/00*** | (2006.01) |
| ***H04S 1/00*** | (2006.01) |
| ***H04R 29/00*** | (2006.01) |

(52) U.S. Cl.

CPC ..... *H04R 3/005* (2013.01); *H04S 1/005* (2013.01); *H04R 29/006* (2013.01); *H04R 2430/03* (2013.01); *H04S 2420/01* (2013.01); *H04S 2420/07* (2013.01)

USPC ..... 381/74

(58) Field of Classification Search

USPC ..... 381/119

See application file for complete search history.

(56) References Cited

U.S. PATENT DOCUMENTS

| | | | | |
|---|---|---|---|---|
| 6,219,427 | B1 * | 4/2001 | Kates et al. | 381/318 |
| 7,117,145 | B1 * | 10/2006 | Venkatesh et al. | 704/200 |
| 7,155,019 | B2 | 12/2006 | Hou | |
| 7,190,103 | B2 | 3/2007 | Gouk et al. | |
| 7,206,421 | B1 | 4/2007 | Taenzer | |
| 2004/0252852 | A1 * | 12/2004 | Taenzer | 381/119 |
| 2005/0156485 | A1 * | 7/2005 | Gouk et al. | 310/317 |
| 2006/0147054 | A1 | 7/2006 | Buck et al. | |

FOREIGN PATENT DOCUMENTS

| | | | |
|---|---|---|---|
| EP | 1 191 817 | | 3/2002 |
| JP | 2003-153372 | A | 5/2003 |
| JP | 2005-512440 | A | 4/2005 |
| JP | 2005-286712 | | 10/2005 |

(Continued)

OTHER PUBLICATIONS

Japanese Office Action in Application No. 2010-522091, mailed Jan. 17, 2012.

(Continued)

*Primary Examiner* — David Vu
*Assistant Examiner* — Jonathan Han
(74) *Attorney, Agent, or Firm* — Nixon Peabody LLP

(57) ABSTRACT

In one embodiment, a method for matching first and second signals includes transforming, over a selected frequency band, the first and second signals into the frequency domain such that frequency components of the first and second signals are assigned to associated frequency bins, generating a scaling ratio associated with each frequency bin, and for at least one of the two signals, or at least a third signal derived from one of the two signals, scaling frequency components associated with each frequency bin by the scaling ratio associated with that frequency bin. The generating comprises determining, during a non-startup period, a signal ratio of the first and second signals for each frequency bin, determining the usability of each signal ratio, and designating a signal ratio as a scaling ratio if it is determined to be usable.

44 Claims, 8 Drawing Sheets

(56) References Cited

FOREIGN PATENT DOCUMENTS

| | | | |
|---|---|---|---|
| JP | 2005-538633 | A | 12/2005 |
| JP | 2007-129373 | A | 5/2007 |
| WO | 03/050942 | A1 | 6/2003 |
| WO | 2004/025989 | A1 | 3/2004 |
| WO | 2006/028587 | | 3/2006 |

OTHER PUBLICATIONS

International Search Report of related PCT/US 08/74113, mailed Nov. 19, 2008.

Office Action in Chinese Application No. 200880111291.4, dated Sep. 22, 2011.

Extended European Search Report in European Application No. 08827843.7, dated Jul. 4, 2013.

Office Action in Japanese Patent Application No. 2010-522091, mailed Dec. 11, 2012.

Office Action in Korean Application No. 10-2010-7006205, dated Jul. 20, 2011.

Written Opinion in International Application No. PCT/US08/74113, mailed Nov. 19, 2008.

* cited by examiner

AUTOMATED SENSOR SIGNAL MATCHING

CROSS REFERENCE TO RELATED APPLICATIONS

This application claims the benefit of U.S. Provisional Patent Application No. 60/965,922, filed on Aug. 22, 2007, entitled "Automated Sensor Signal Matching Method and Device", the disclosure of which is hereby incorporated by reference for all purposes.

TECHNICAL FIELD

The present disclosure relates generally to matching of multiple versions of a signal, for example versions generated by multiple microphones in a headset, earpiece or other communications device.

BACKGROUND

The matching of sensor signals is needed in many applications where multiple versions of the same signal or signals are gathered. As a result of the natural variations within any device or system, the sensitivity of individual sensors differs each from the other and therefore the resulting electrical output signals may not be the same even though they have the identical input signal. Similarly, there are natural variations in the multiple signal handling electronics, like the sensor signal pre-conditioning circuits, that can add more differences to what should be identical signals. Multi-sensor or sensor array applications span the range from medical diagnostic imaging systems (ultrasound imagers, MRI scanners, PET scanners), to underwater sonar systems, to radar, to radio and cellular communications, to microphone systems for gunshot detection or voice pick up.

Multi-sensor sound pickup systems are becoming more common as the performance limitations of single microphone systems, especially in high noise situations, are rapidly being approached. Multi-microphone systems offer significantly improved performance capabilities, and therefore are to be preferred for use, particularly in mobile applications where the operating conditions can not be predicted. For this reason, multiple microphone pickup systems, and the associated multi-microphone signal conditioning processes, are now being used in numerous products such as Bluetooth® headsets, cellular handsets, car and truck cell phone audio interface kits, stage microphones, hearing aids and the like.

Numerous systems have been developed that depend upon microphone arrays for providing multiple spatially separate measurements of the same acoustic signals. For example, in addition to the well known beam forming methods, there are now generalized sidelobe cancellers (GSC), blind signal separation (BSS) systems, phase-based noise reduction methods, the Griffiths-Jim beamformer, and a host of other techniques all directed at improving the pick up of a desired signal and the reduction or removal of undesired signals.

However, along with the benefits of multiple microphone pickup systems come new challenges. One major challenge is that to achieve the performance potential of such systems requires that the sensors' signals be well-matched, a process often called "microphone matching." This is because, depending upon the specifics of the system, magnitude mismatches, phase mismatches or both may severely degrade performance. Although the tolerance for microphone mismatch of each of these systems varies, most are quite sensitive to even small amounts of mismatch.

In many applications, even well-matched microphone elements will have significantly different response characteristics once mounted in microphone housings and placed or worn in the manner intended for the application. Even user-dependent variables can have substantially differing impact on the response characteristics of the individual microphones of a microphone array.

Another concern with multiple microphone systems is manufacturability. Pre-matched microphones are expensive and can change characteristics with time (aging), temperature, humidity and changes in the local acoustic environment. Thus, even when microphones are matched as they leave the factory, they can drift in use. If inexpensive microphones are to be used for cost containment, they typically have an off-the-shelf sensitivity tolerance of ±3 dB, which in a two-element array means that the pair of microphones can have as much as a ±6 dB difference in sensitivities—a span of 12 dB. Further, the mismatches will vary with frequency, so simple wide band gain adjustments are usually insufficient to correct the entire problem. This is especially critical with uni-directional pressure gradient microphones where frequency-dependent mismatches are the rule rather than the exception.

What is needed to make such systems perform at their highest level is an automatic, robust, accurate and rapid acting sensor sensitivity difference correction system, sometimes called a sensor matching system, capable of performing frequency dependent, real time matching of multiple sensor signals.

OVERVIEW

As described herein, a method for matching first and second signals includes converting, over a selected frequency band, the first and second signals into the frequency domain such that frequency components of the first and second signals are assigned to at least one associated frequency bands, generating a scaling ratio associated with each frequency band, and for at least one of the two signals, or at least a third signal derived from one of the two signals, scaling frequency components associated with each frequency band by the scaling ratio associated with that frequency band. The generating comprises determining, during a non-startup period, a signal ratio of the first and second signals for each frequency band, determining the usability of each such signal ratio, and using a signal ratio in a calculation of a scaling ratio if it is determined to be usable.

Also described herein is an apparatus for matching first and second signals. The apparatus includes means for converting, over a selected frequency band, the first and second signals into the frequency domain such that frequency components of the first and second signals are assigned to associated frequency bands, means for generating a scaling ratio associated with each frequency band, and means for scaling frequency components associated with each frequency band by the scaling ratio associated with that frequency band for at least one of the two signals, or at least a third signal derived from at least one of the two signals. The generating comprises determining, during a non-startup period, a signal ratio of the first and second signals for each frequency band, determining the usability of each signal ratio, and using a signal ratio in a calculation of a scaling ratio if it is determined to be usable.

Also described herein is a program storage device readable by a machine, embodying a program of instructions executable by the machine to perform a method for matching first and second signals. The method includes converting, over a selected frequency band, the first and second signals into the frequency domain such that frequency components of the first and second signals are assigned to associated frequency bands, generating a scaling ratio associated with each frequency band, and for at least one of the two signals, or at least a third signal derived from at least one of the two signals, scaling frequency components associated with each frequency band by the scaling ratio associated with that frequency band. The generating comprises determining, during a non-startup period, a signal ratio of the first and second signals for each frequency band, determining the usability of each signal ratio, and using a signal ratio in a calculation of a scaling ratio if it is determined to be usable.

Also described herein is a system for matching a characteristic difference associated with first and second input signals. The system includes a circuit for determining the characteristic difference, a circuit for generating an adjustment value based on the characteristic difference, a circuit for determining when the adjustment value is a usable adjustment value, and a circuit for adjusting at least one of the first or second input signals, or at least a third signal derived from at least one of the first or second input signals, as a function of the usable adjustment value.

Also described herein is a method for matching first and second signals that includes converting, over a selected frequency band, the first and second signals into the frequency domain such that frequency components of the first and second signals are assigned to associated frequency bands, generating a correction factor associated with each frequency band, and for at least one of the two signals, or at least a third signal derived from at least one of the two signals, correcting at least one frequency component associated with each frequency band by arithmetically combining said correction factor with said signal associated with each such frequency band. The generating includes determining, for a signal difference of the first and second signals for each frequency band, the usability of each signal difference, and using such signal difference in the calculation of the correction factor if it is determined to be usable.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Figure 1:
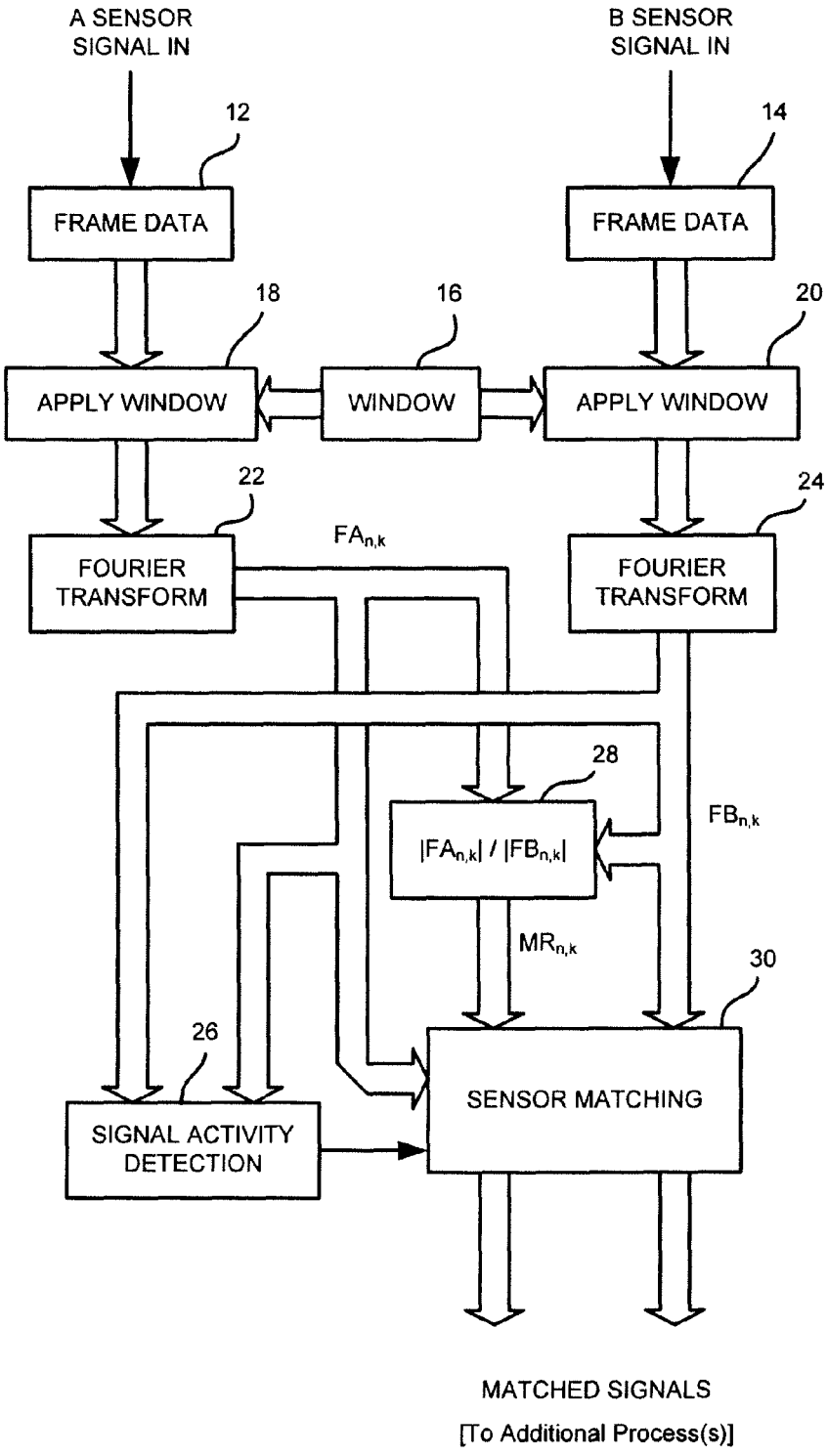
FIG. 1 is a block diagram of the front end of one common type of signal processing system showing the context within which a sensor matching process 30 is used.

Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with this disclosure, the components, process steps, and/or data structures described herein may be implemented using various types of operating systems, computing platforms, computer programs, and/or general purpose machines. In addition, those of ordinary skill in the art will recognize that devices of a less general purpose nature, such as hardwired devices, field programmable gate arrays (FPGAs), application specific integrated circuits (ASICs), signal processors such as digital signal processors (DSPs) or the like, may also be used without departing from the scope and spirit of the inventive concepts disclosed herein. Where a method comprising a series of process steps is implemented by a computer or a machine and those process steps can be stored as a series of instructions readable by the machine, they may be stored on a tangible medium such as a computer memory device (e.g., ROM (Read Only Memory), PROM (Programmable Read Only Memory), EEPROM (Electrically Eraseable Programmable Read Only Memory), FLASH Memory, Jump Drive, and the like), magnetic storage medium (e.g., tape, magnetic disk drive, and the like), optical storage medium (e.g., CD-ROM, DVD-ROM, paper card, paper tape and the like) and other types of program memory.

Herein, the term sensor (microphone) signal may refer to a signal derived from a sensor (microphone), whether directly from a sensor (microphone) or after subsequent signal conditioning has occurred.

In an automatic sensor signal matching method and apparatus of the present disclosure, which may be referred to herein as automatic microphone matching or "AMM" system, matching the sensor output signals in a multi-sensor system over a full band of frequencies, or over one or more sub-bands is performed. The methods and apparatus described herein can compensate for differences in nominal sensor sensitivity, in frequency response characteristics of individual sensors, and as caused by local disturbances to the sensed field. Adjustment of sensor output signals occurs when the sensor input signals are known to be substantially identical. Identification of this condition is inferred from specific known conditions of the particular application, and by a process that detects when an environmental condition is met from which equal sensor input can be inferred.

The method and apparatus of the present disclosure, which can be applied in a broad range of applications, is described here in an exemplary system of a speech-based communication device, where the automatic sensor signal matching is applied to match signal magnitudes in each of multiple frequency bands. In the example system, the user's voice is the desired signal, and, from the standpoint of the communication purpose, other sounds impinging on the device from the environment constitute "noise". Far-field sounds are deemed to be "noise," so conditions consistent with the acoustic signal sensed by each sensor element being equal include when far-field noise is the only input (determined by a noise activity detector or "NAD"), or the presence versus absence of a voice signal (determined by a voice activity detector or "VAD"). These devices, some of which may be known in the art, may be collectively referred to herein as signal activity detectors or "SAD"s. Where it is known a priori that the sensor input signals inherently meet the necessary condition of equality at virtually all times, such as in hearing aids, the basic automatic matching method disclosed herein can be implemented without use of a SAD. In another case, a form of NAD integral to the present automatic matching process is disclosed and included in one of the exemplary embodiments. However, the fundamental matching method disclosed herein is compatible with any form of SAD and is not limited to the use of the integral SAD technology. Thus, exemplary embodiments are also shown where an external SAD provides a control signal, or "flag", that signals to the automatic matching process when the necessary input condition is met.

For simplicity and ease of understanding, the exemplary embodiments herein are described in terms of matching the signal sensitivity for two sensors, but any size array of sensors can be accommodated, for example by simply matching each sensor's signal to that of a common reference sensor within the array, or, for a more robust system, to the average of all or some of the sensors. It will be recognized by those practiced in the art that the method and apparatus of the present disclosure are not limited to matching sensor signal magnitudes, and are equally applicable to matching any sensor signal characteristic, including phase. For phase matching, for example, the process differs primarily in that the correction values are determined by subtraction and applied by addition in the linear domain for phase matching, rather than determined by subtraction and applied by addition in the logarithmic domain for magnitude matching. Similarly, while the exemplary embodiments are directed to matching microphone arrays in communications class systems, it will be apparent to those of ordinary skill in the art that the sensor matching method disclosed herein can be applied more generally to other sensor systems in other types of applications.

Benefits of the arrangements disclosed herein may include one or more of:

- Precision (matching typically within 0.03 dB)
- Rapid tracking of sensor and local acoustic changes
- Correct performance under low input SNR conditions and with high input noise
- Level independent
- Continuous real-time adjustment
- Works with off-the-shelf microphone elements
- Low computational complexity and cost
- Low power consumption
- High manufacturability
- Compatible for a wide range of applications—not just acoustic The breadth of potential application of the disclosure herein extends to use with a large variety of both narrow-band and broadband sensor arrays, but the description herein is made using two microphone array example embodiments operated within a communication system device such as a mobile headset or handset. Headsets are often configured with dual microphones and a processor, often a digital signal processor (DSP) in order to provide improved spatial pickup patterns and/or other noise reduction by signal processing methods. Commonly the microphone elements themselves have a sensitivity/frequency response tolerance that will adversely impact the performance of the desired processing, and the configuration of the microphone elements within the headset's housing, as well as the placement of the housing on a user, will impact the frequency response of the two microphones differently. In addition, the acoustic head related transfer functions (HRTFs) will vary between users for the same headset, so microphone matching that is performed in place on a user and in operation can perform better than matching that adjusts for the headset hardware without a user. A microphone matching process such as the present invention, that continues to automatically and transparently update its matching condition throughout the headset's life, will not only correct for hardware component tolerances and short term changes in the acoustic configuration due to changes of user and circumstance, but will also compensate for the kind of time dependant drifts that are inherent with sensor hardware.

As disclosed herein, input signals are created, and made available from, other signal processes operating within the headset system in which the present invention is a part. Thus, this signal matching method and device works with available signals in the headset. In one application, the critical input signal is a ratio of the STFT magnitudes of each input signal and access to values proportional to the individual levels of each microphone signal are not available. As such, the separate sensor signal magnitudes are not necessarily of use, and the matching system can operate only with a magnitude ratio. A control signal that indicates when the magnitude ratio is usable for matching purposes is also available to the matching system.

Figure 2:
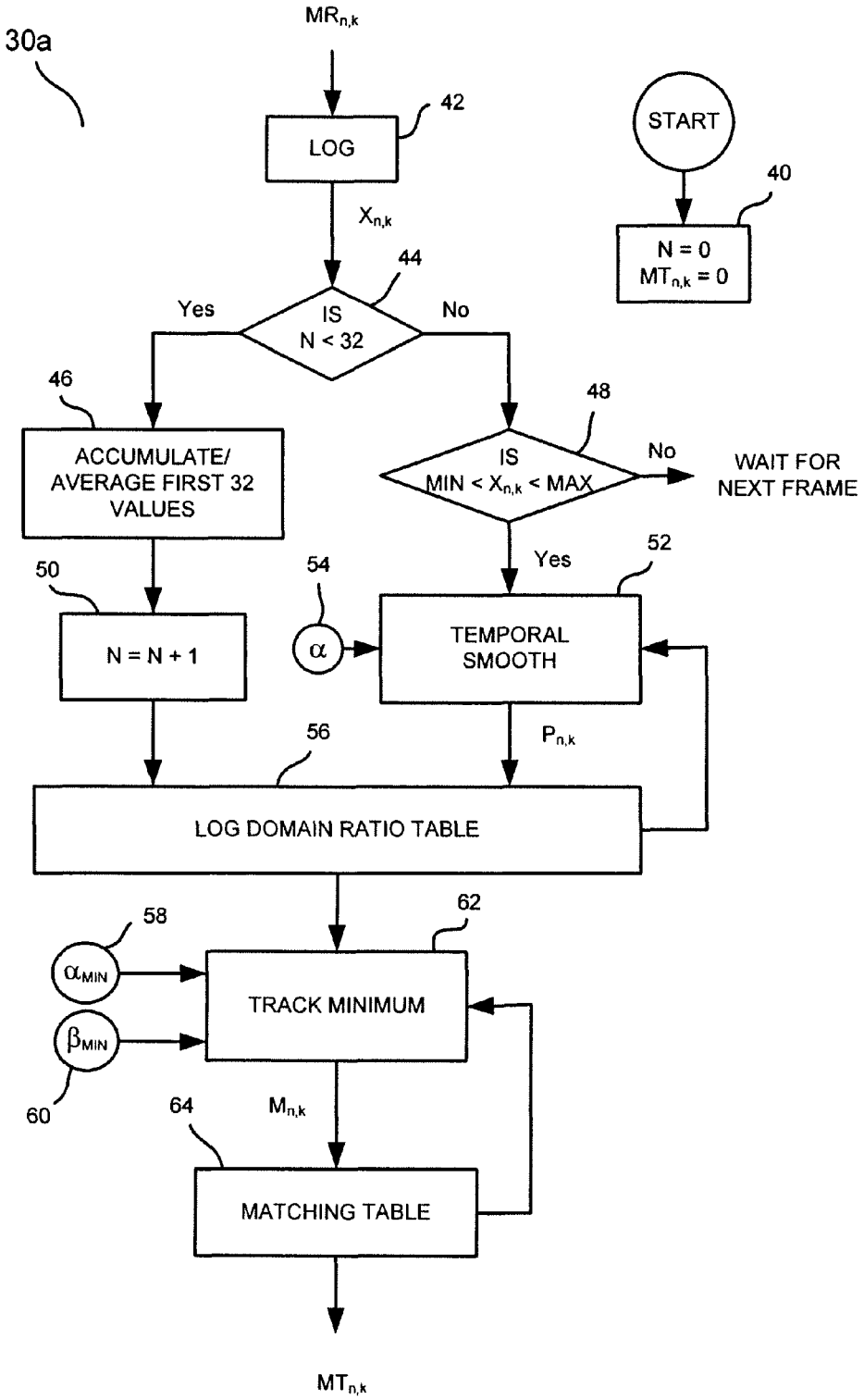
FIG. 2 is a process flow chart of a first section 30*a* of an example embodiment.

FIG. 1 is a block diagram of the front end of one type of signal processing system showing the context within which a sensor matching process 30 is used. Process 30 can be implemented in a general purpose processor or microprocessor, or in a dedicated signal processor, or in a specialized processor such as a digital signal processor (DSP), or in one or more discrete circuits each carrying out one or more specified functions of the process. Thus, corresponding to FIGS. 1 and 2 is a circuit block diagram shown in FIG. 10 and depicting various circuits that can be used to implement the processes described in FIG. 1.

The sensor matching process 30 can operate as a single-band or as a multi-band process, wherein the single-band version produces a frequency-independent correction and wherein the multi-band process allows for frequency dependent-matching. Process 30 is a multi-band implementation, with the time domain signal being converted into multiple frequency bands. This multi-band conversion can be accomplished by use of a bank of bandpass filters, by the application of a frequency domain transform process such as the Fourier transform, or by any other process for such conversion. Conversion to the frequency domain is well understood in the art, and may be accomplished by use of the Short Time Fourier Transform (STFT) technique shown in FIG. 1 or other frequency domain conversion method. Since systems with which the automatic matching process disclosed herein is useful are likely to already use the STFT method for other system signal processing tasks, such as beam forming, spectral subtraction, voice activity detection, equalization, and so on, frequency domain conversion is likely to already be available. In that case, the automatic matching process disclosed herein would require a relatively small amount of additional processing.

The example embodiments disclosed herein employ the Fast Fourier Transform (FFT), and the automatic matching process is carried out in the frequency domain. Therefore, per the example systems, the input signal is converted to the frequency domain prior to the automatic matching processing. Conversion of the sensor input signals to the frequency domain by the Fourier transform breaks the signal into small frequency bands that are associated with corresponding frequency bins, and the frequency bands themselves may be referred to herein as the frequency bins, or simply as bins, for shorthand purposes only. The process disclosed here is described as operating on a bin-by-bin basis, but it will be appreciated that bins can be grouped, and the process carried out on the bands created by such grouping of bins.

Figure 10:
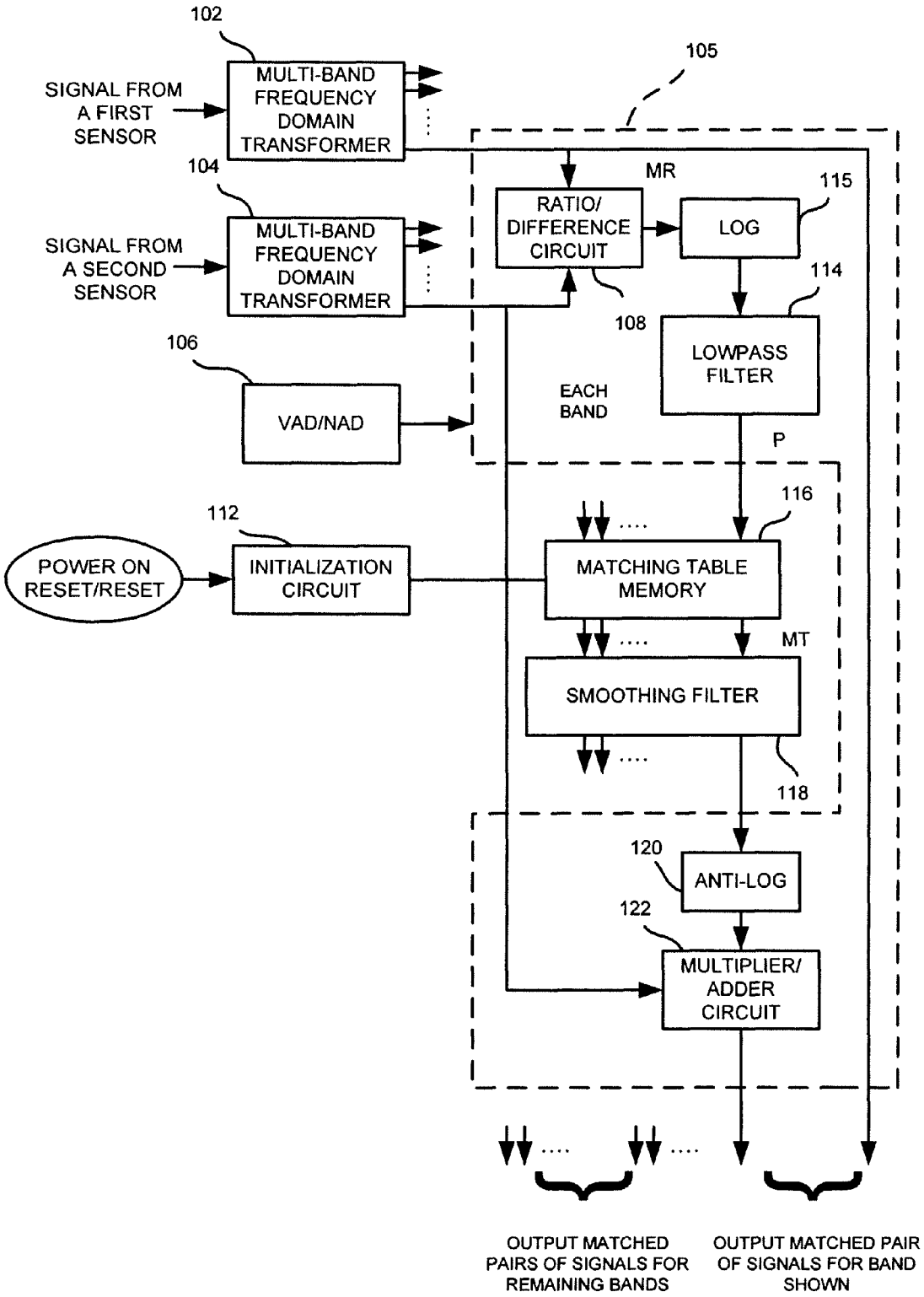
FIG. 10 is a schematic drawing of various circuits that can be used to implement the processes described in FIG. 1.

With reference again to the system block diagrams of FIGS. 1 and 10, the analog input signals from sensors A and B (or any two signal sources that are being matched) are converted from the analog domain to the digital domain by analog-to-digital (A/D) converters (not shown) to produce the digital input signals "A Sensor Signal In" and "B Sensor Signal In." These digitized input signals are then framed by framing blocks 12 and 14 respectively; a weighting window is created by windowing block 16; and, the window is applied by windowing application blocks 18 and 20 respectively. The framed, windowed data are then converted to the frequency domain by Fourier transform blocks 22 and 24 respectively (which may be the well known FFT or other appropriate transform process), and each frequency domain signal, labeled as $FA_{n,k}$ and $FB_{n,k}$ (where n is the frame or time index and k is the bin or frequency index) is provided to signal activity detection block 26, as well as to sensor signal ratio block 28. In FIG. 10, multi-band frequency domain transformers 102 and 104 conduct the frequency transformations, although in the single-band implementation these can be omitted. Further, in the more generalized FIG. 10 illustration, the signals A and B that are input to the circuit may be analog signals that are the result of analog conversion further upstream (not shown in FIG. 10) of signals from the digital domain, or that are analog signals from an all-analog system requiring no such conversion. Alternatively, signals A and B may be digital signals. Multi-band frequency domain transformers 102 and 104 are intended to generally be any frequency domain conversion devices, including analog filter banks or digital filter banks (for which upstream conversion to the digital domain may be required), digital transformers (Fourier transform, Cosine transform, Hartley transform, wavelet transform, or the like, (also requiring possible upstream digital conversion). Basically any means for breaking up a wideband signal into sub-bands may be utilized. The outputs from the multi-band frequency domain transformers 102 and 104 are provided to the circuit 105 depicted in the dashed lines in FIG. 10, whose operation is repeated for each frequency bin using the same circuit 105 (serial processing), or using a corresponding circuit 105*n* associated with each bin (parallel processing).

Signal activity detection block 26, which can embody any of a number of well known VAD (voice activity detector) or NAD (noise activity detector) processes, provides a control signal, or "usability" indication signal, created by the detection of periods when input signals to the sensors are consistent with correct matching. These signals are provided by circuit 106 in FIG. 10. The control signal from block 26 (circuit 106) is provided to sensor matching block 30 enabling or disabling the matching process at appropriate times as will be described below. Of course, this control signal is also available to other system processes if needed. The sensor ratio block 28 generates a scaling ratio for each pair of corresponding same-frequency band/bin values in the signals $FA_{n,k}$ and $FB_{n,k}$ (a corresponding ratio/difference circuit 108 is shown in FIG. 10.) and passes those scaling ratios to the sensor matching block 30 as the signal $MR_{n,k}$. In an example embodiment, each signal of a pair of digital communications audio signals with an 8 ksps sample rate is framed into 512-sample frames with 50% overlap, windowed with a Hanning window, converted to the frequency domain using an FFT (Fast Fourier Transform), and provided to signal activity detector 26, signal ratio block 28 and to sensor matching block 30.

When matching the signals from two sensors, a corrective adjustment is typically made in the path of the signal from at least one of the sensors. It will be understood that the corrective adjustment may be applied exclusively in either one of the sensor signal paths. Alternatively, it may be applied partially in one path and partially in the other path, in any desired proportion to bring the signals into the matching condition.

Sensor matching block 30 corrects the frequency domain signals on a bin-by-bin basis, thus providing frequency-specific sensor matching. In some systems, the determined correction may be implemented by adjustment of a gain applied to one or both sensor output signals; however, in practical applications the sensor output signals are typically inputs to subsequent processing steps where various intermediate signals are produced that are functions of the sensor signals, and it is contemplated that the gain adjustment is applied appropriately to any signal that is a function of the respective sensor signal or is so derived therefrom. As further detailed below, a scaling ratio of the two frequency domain signals is calculated and used in the sensor matching process disclosed herein. Where subsequent processes use these scaling ratios, the correction determined by the sensor matching process can be applied by multiplication or division (as appropriate) of the scaling ratios, rather than of the signal itself, when the scaling ratios and the gain are in the linear domain; or by addition/subtraction when the scaling ratios and the gain are in the logarithmic domain. More generally, the correction determined by the sensor matching process can be arithmetically combined (as appropriate) with any signals ultimately used as gain/attenuation signals for sensor signals or signals that are functions of sensor signals.

Figure 3:
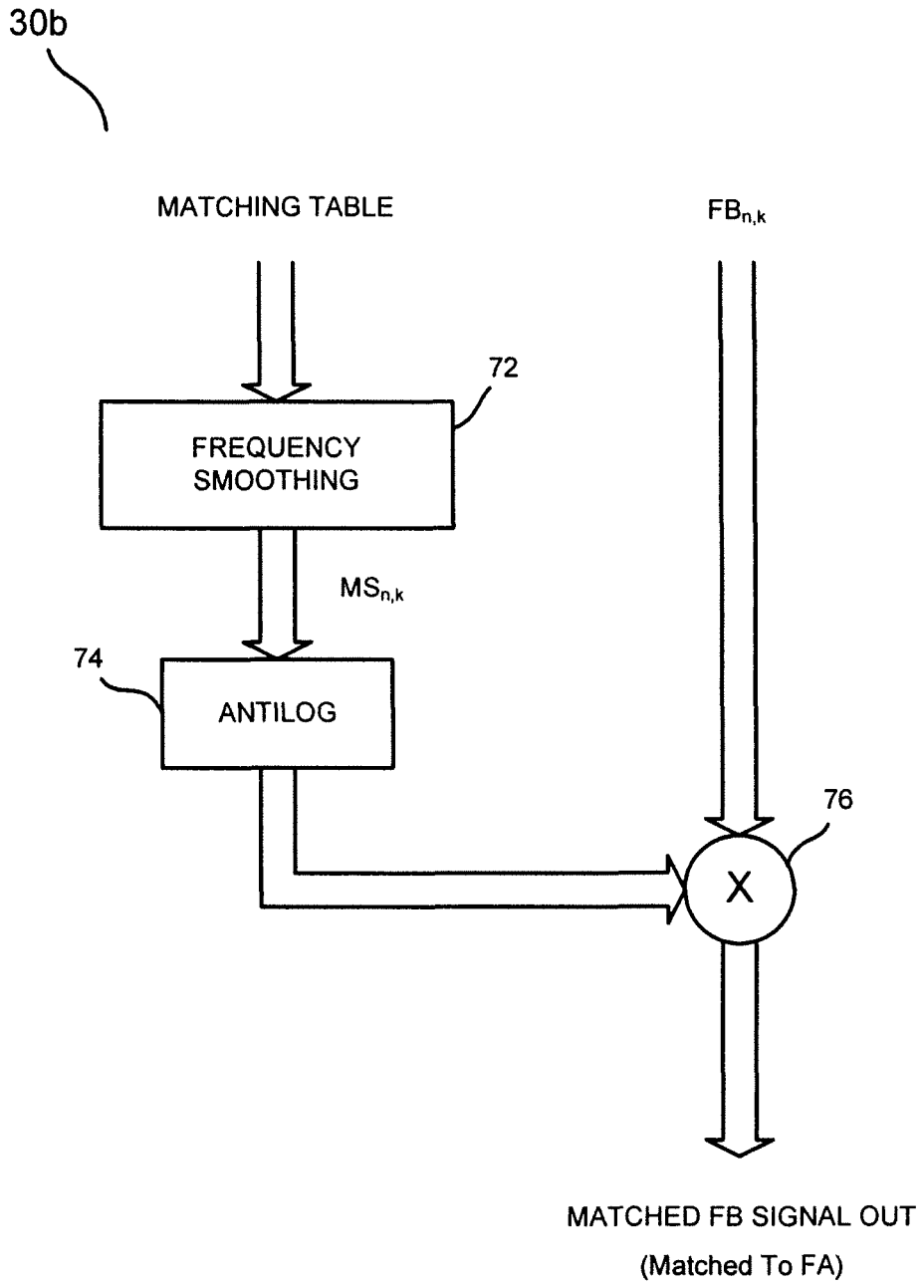
FIG. 3 is a process flow chart 30*b* of the remainder of the same example embodiment of FIG. 2.

FIG. 2 is a process flow chart of a first section 30*a* of an example embodiment. FIG. 3 is a process flow chart 30*b* of the remainder of the same example embodiment; however the section shown in FIG. 3 is also common to other example embodiments as will be described below. The section 30*a* of the sensor matching process, as shown here, is performed independently on each frequency bin of each frame of data. As such, FIG. 2 represents the process for any one value of n and one value of k—that is, the process represented in FIG. 2 is repeated for each bin and on each frame of data.

At start-up, when the matching process is activated but no historical data is present, the processing step of block 40 initializes a frame count variable N to 0, and clears the correction values $MT_{n,k}$ in a matching table matrix 64 to all 0s (the logarithmic domain equivalent of unity in the linear domain). The initial correction values in the matching table matrix need not be set to all 0s, but may be set to any value deemed appropriate by the system designer, since after a short time of operation the values will automatically adjust to their appropriate values to produce the matching condition anyway. The matrix 64 includes a set of entries, one for each frequency bin, that are subject to updating as explained below. After clearing the signal values, $MT_{n,k}$ in matching table matrix 64 to all 0s, the logarithm of the input signal, $MR_{n,k}$, from signal ratio block 28 of FIG. 1, is calculated in the log step 42 to produce the log ratio signal $X_{n,k}$. A log circuit for this purpose is depicted at 115 in FIG. 10.

In an example embodiment in which off-the shelf microphones compose the sensor array that includes microphones generating Signals A and B, the initial mismatch can be greater than 6 dB. The time required to reduce this amount of initial mismatch until achieving a matched condition may be long and therefore noticeable to the user. To speed up the matching acquisition process at the start of operation, it can be assumed that for a while the initial input signal to the sensors (microphones) is only noise, and this signal condition should produce equal sensor signals. Thus, a rapid initialization of the matching table 64 can be achieved by averaging the first Q frames, which are all assumed to be noise-only, and setting the initial matching table to the averaged values as is described more fully below. Q can be any value greater than or equal to 1. In one example embodiment, Q can be selected to be 32, and frame counts lower than Q indicate that the process is in the initialization period.

At test step 44, the value of frame count variable N is checked to determine if the process is operating in the start-up/initialization period. If so, the values of $X_{n,k}$ are passed to step 46, in which the first 32 values are accumulated/averaged. Thus when N reaches the value of Q, a determination of an average of the first 32 frame values for each FFT bin is made. The average is then passed to logarithm domain ratio table step 56. For each new frame of the start-up period, the frame count variable N is incremented by 1 in step 50 so that when the current value of N is tested at step 44, eventually N will have reached the pre-determined value of Q (for example 32) and for all frames thereafter the signal $X_{n,k}$ will instead be diverted to test step 48. The value of frame count variable N will then remain equal to Q.

Accumulate/average first 32 values step 46 either sums its input values for the first Q frames or averages input values for the first Q frames. At the end of the Q frame start-up period, the sum is divided by Q to create an average value which is then sent to logarithm domain ratio table step 56, or the final average value is then so sent. Remembering that FIG. 2 shows the process for any one frequency bin and that all bins are simultaneously being calculated, the log domain ratio table step 56 will contain a set of frequency-specific scaling ratio values—that is, a scaling ratio for each frequency bin. Thus, either averaging method will initialize the set of values contained in the log domain ratio table to a set very close to the correct values required for a match when the matching system is in operation.

While it is contemplated that the average scaling ratio calculated for the start-up period in the process of the accumulate/average first 32 values step 46 will be the arithmetic mean, other mathematical means, such as the harmonic mean, could alternatively be utilized. Also, while the example embodiment is described with the calculations in the logarithmic domain, an equivalent process can be performed in the linear domain. For example, the geometric mean of the first 32 values in the linear domain is the equivalent of an arithmetic mean of the first 32 values in the logarithmic domain.

In the example embodiment, the values in matching table 64 remain at 0 (in the logarithmic domain, and unity in the linear domain) until the first 32 frames have been completed. Alternatively, intermediate averages can be passed to log domain ratio table 56 to be used in subsequent steps but still prior to completion of 32 frames. 32 frames require slightly less than ¼ second, and is an acceptable start-up delay. However, the start-up delay can alternatively be modified by changing the selected value of Q. The start-up procedure is performed in by an initialization circuit 112 in FIG. 10.

To assure that the matching process is performed only when a current frame of data represents acceptable data for matching purposes, some form of discrimination process must be used to determine the "usability" of the current frame of data. That is, a determination of when the input signals are matchable needs to be made, and that determination is based on satisfaction of a predetermined condition, which may be an indication from a SAD (signal activity detector) circuit, which may be in the form of a VAD or a NAD. Alternatively, that indication may be provided by a matchable signal determination (MSD) process.

In the matchable signal determination (MSD) process, explained with continued reference to FIG. 2, a circuit is provided for performing functions of a test step 48 and minimum tracking step 62. Since in the current example embodiment the signal match is best achieved during periods of noise-only input, steps 48 and 62 operate to effectively perform a VAD function. For a headset application for example, the scaling ratio values of signal $MR_{n,k}$ are known to be near zero dB for a noise-only input signal condition, and around 2 to 4 dB for speech. After the start-up/initialization process described above, the log domain ratio table 56 will have been initialized to a set of values very close to those for noise-only input conditions. Thus, at test step 48, signal $X_{n,k}$ is tested to see if, for the next, new frame value, the signal $X_{n,k}$ is within a small tolerance around the value stored in the log domain ratio table. If not, then it is assumed that the current frame contains unusable data for matching purposes, and the process of FIG. 2 holds the last frame's values and waits for the next usable frame of data. However, if the frame is declared usable, then the signal $X_{n,k}$ is sent to temporal smooth step 52.

The MIN and MAX test values are computed as follows. For example, if the log domain ratio table value is +3 dB for a particular frequency, then the current value of $X_{n,k}$ is tested to determine if it is within ±T of 3 dB, where T is a predetermined tolerance value. Thus MAX=log domain ratio table value+T and MIN=log domain ratio table value−T.

Typical tolerance values range between 0.25 and 1 dB for a microphone application, although different values, readily determined by those of ordinary skill in the art, may be used for other applications and embodiments. Also, in alternative embodiments, the test might be asymmetrical—that is, MAX=log domain ratio table value+T and MIN=log domain ratio table value−T', where T≠T'.

Once log domain ratio table 56 is initialized, subsequent frames of data are sent to test step 48, and if declared usable, are sent to temporal smoothing step 52. Temporal smoothing can be implemented with any type of lowpass filter, such as filter 114 of FIG. 10, but one commonly used and efficient filter is the exponential filter described by the equation $$P_{n,k}=P_{n-1,k}+\alpha\cdot(X_{n,k}-P_{n-1,k}) \quad (1)$$

where α is a pre-determined smoothing constant with a value between 0 and 1, and typically between 0.001 and 0.2. The value used in the exemplary embodiment is 0.05. Temporal smoothing reduces time dependent statistical fluctuations in the matching correction value. It is known that mismatches are relatively slow to occur—that is, the most rapid mismatches are due to changes in the acoustic environment near the microphones, as when a user puts on a hat or places a phone to an ear. More rapid variations are not "real" and occur as a result of electrical noise and other statistical phenomena not related to microphone mismatch. Thus, well-chosen temporal smoothing (proper choice of $\alpha$) will reduce the statistical fluctuations without affecting the ability of the matching process to correct actual mismatch variations in real-time. The output of temporal smoothing step 52 is the signal $P_{n,k}$, which, along with all the values for the other bin frequencies, populates the log domain ratio table 56 after the start-up period. Log domain ratio table 56 thus updates every frame for which test step 48 has determined "usable" data is available—that is, a matchable condition is satisfied.

The input signal to minimum step 62 is the log domain ratio table values contained in the table step 56, in addition to two tracking filter constants $\alpha_{MIN}$ 58 and $\beta_{MIN}$ 60. The minimum tracking process, performed by a suitable circuit or DSP (not shown) that may or may not perform other functions, is based upon the knowledge, as described above, that expected input signals for the example microphone application are centered at either 2-4 dB or 0 dB. Since the input signals will be equal only for the 0 dB case, and this case is the lowest of the two values, then the minimum of the log domain ratios contained in table 56 should reflect the usable data for matching purposes. Thus, following the minimum of these data values should give a best match and should ignore unusable data—that is, data with higher ratios.

The track minimum step 62 operates according to the following equation $$M_{n,k}=M_{n-1,k}+\min[\beta_{MIN},\alpha_{MIN}\cdot(P_{n,k}-M_{n-1,k})] \quad (2)$$

where constants $\alpha_{MIN}$ and $\beta_{MIN}$ have values between 0 and 1. In an example embodiment, $\alpha_{MIN}=0.25$ and $\beta_{MIN}=0.00005$. The output of track minimum step 62 is the signal $M_{n,k}$ and is stored in matching table step 64 for further use. Matching table memory 116 in FIG. 10 provides storage functionality. After storage in matching table 64 (memory 116), this frame's matching table correction values are available to the remaining section of the matching process as the signal $MT_{n,k}$.

As previously explained, FIG. 3 shows the remaining portion of the process, and represents a procedure implemented for each frame. At frequency smoothing step 72 of FIG. 3, the matching table correction values $MT_{n,k}$ for the current frame undergo substantial reduction or removal of bin-to-bin variations by filtering across the entire frequency bandwidth. Smoothing functionality is provided by a smoothing filter 118 depicted in FIG. 10. Since the process can be implemented as a single wideband process or in multiple sub-bands, the term sub-band used here refers to each full band, whether it is a single wide band covering the full bandwidth of the input, or whether it is any one of multiple sub-bands of that signal. The filtering covers the bandwidth of each sub-band, and therefore is a filtering over all bins within that sub-band.

As described here, a single full bandwidth sub-band, exclusive of the DC and Nyquist bins, is used. Frequency smoothing is well known in the art and numerous methods for its implementation are available. Frequency smoothing step 72 may use any type of smoothing, including exponential filtering, wherein $$MS_{n,k}=MS_{n,k-1}+\delta\cdot(MT_{n,k}-MS_{n,k-1}) \quad (3)$$

where $\delta$ is a smoothing constant with a value between 0 and 1, and typically between 0.1 and 0.3. Alternatively, the frame of matching table values may be smoothed by applying well known convolutional or spline methods. The result of this smoothing is to produce a microphone sensitivity correction in the logarithmic domain that accurately tracks microphone signal mismatches. Frequency smoothing step 72 yields the signal $MS_{n,k}$.

The signal $MS_{n,k}$ is provided as the input signal to the antilogarithm step 74 where the value for each frequency bin is converted to the linear domain for application to one or (proportionately) to all sensor signals in order to effect the correction and matching of those signals. Corresponding circuit 120 in FIG. 10 performs this function. In FIG. 3, the exemplary embodiment uses the antilog output from step 74 to multiply, in step 76, the frequency domain version of the sensor B signal input $FB_{n,k}$, thereby changing signal $FB_{n,k}$ to match the sensor A signal input $FA_{n,k}$. A multiplier/adder circuit 122 in FIG. 10 is provided for this purpose. As described previously, either sensor input signal can be selected for application of the correction. To apply the correction instead to the sensor A signal input, $FA_{n,k}$, the values in signal $MS_{n,k}$ would first be negated before the antilogarithm in step 74 is applied. This is the same as taking the reciprocal of the values in the post-antilog correction signal before multiplying the sensor A input signal, $FA_{n,k}$, by these new correction values.

As indicated above, the entire matching process can be performed in the linear domain rather that the logarithmic domain, which would eliminate the need to incorporate the antilog process of step 74, but would provide the same linear correction factor to multiply step 76. As also indicated above, it would be fully consistent with the disclosure herein to apply the correction factor by apportioning it between the two sensor signals, or by applying it to the sensor signals ratios, or by applying it to any other intermediate or derivative signal that is a function of one or both of the sensor signals rather than directly to a sensor signal. It would also be consistent with the disclosure herein to apply the correction factor to an intermediate signal that is subsequently used either to provide gain/attenuation to one or both of the sensor signals or to provide gain/attenuation to another intermediate signal that is a function of one or both of the sensor signals. It will also be appreciated that the signals can be matched to any reference signal, such as the average of two or more of the input signals or any third reference. As described in the example herein, the reference signal can be considered the "first" input, and the "second," which may be one of the sensor input signals, is made to match the first.

In this example system, the matching correction is applied all to one of the pair of signals so that the output of multiplication step 76 is the matched signal available for any further processing. As shown in FIG. 1, the output from automatic sensor matching step 30 is, for this two-sensor example, a pair of matched sensor signals.

Figure 6:
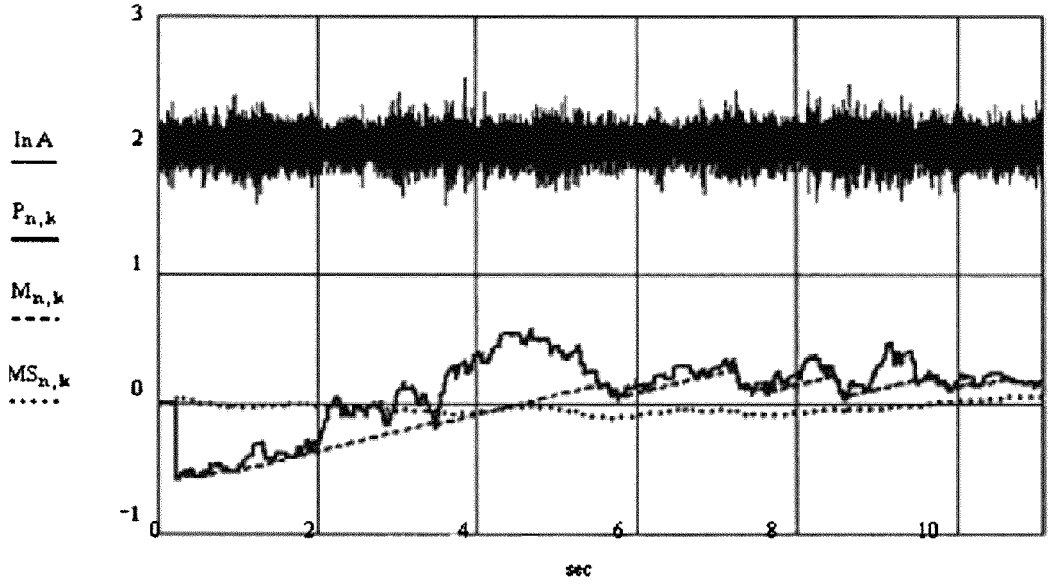
FIG. 6 is a plot showing the internal signals characteristic of system and method described herein.

To further describe the operation of the present signal matching system, the internal signals will be described with reference to FIG. 6. The top curve in FIG. 6 is a section of a noise-only acoustic input as recorded from the electrical output of sensor A after A/D conversion. The horizontal axis for the top curve is frequency in Hz (but is not labeled as such), and the vertical axis is in linear volts. The vertical axis is in dB—that is, logarithmic—for the lower curves, and is labeled accordingly. For this input signal of FIG. 6, the correction should be very close to zero dB. The solid line in the lower portion of the graph shows the associated signal $P_{n,k}$ for k=64, (1000 Hz), as frame count n varies from 0 to 1573 (0 to 11 sec). The significant statistical variation over time is evident in this plot. The minimum tracker output signal $M_{n,k}$ is shown as the dashed line, and the smoothed output signal $MS_{n,k}$ is shown by the dotted line. Note that the resulting correction value for this frequency which is the signal $MS_{n,k}$ is quite smooth and accurate (near zero). Tests have shown that this automatic matching system is capable of maintaining matched signals within a few one-hundredths of a dB. The deviations from zero indicated in FIG. 6 are actual mismatch variations from acoustic changes occurring in the environment local to the microphone array.

Figure 7:
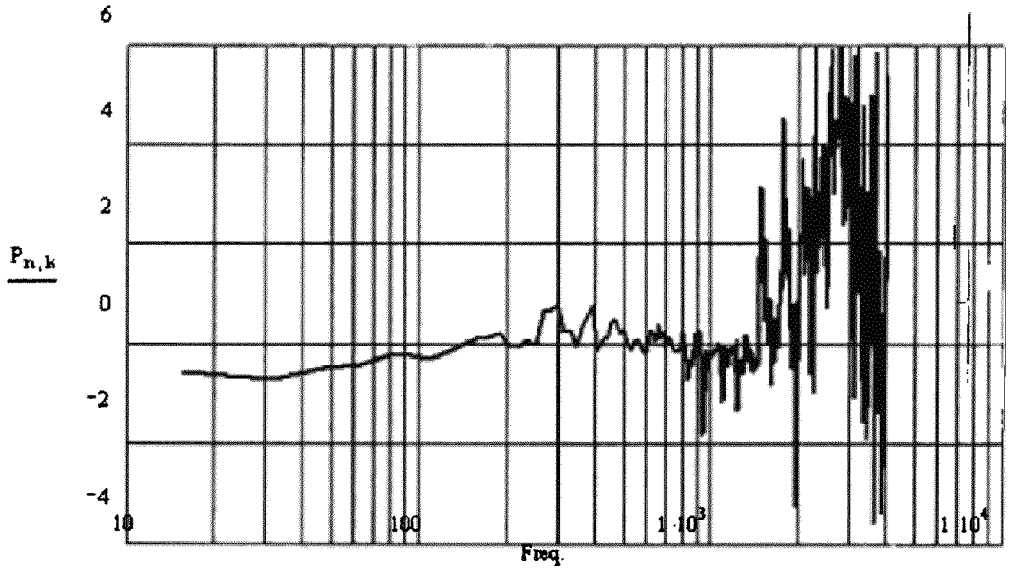
FIG. 7 shows the signal $P_{n,k}$ for frame n=1500 as plotted vs. frequency in hertz (Hz).

FIG. 7 shows the signal $P_{n,k}$ for frame n=1500 as plotted vs. frequency in hertz (Hz). Note the significant variability, particularly at higher frequencies. These fine variations are due to acoustic interference and are not due to mismatch. However, the general overall shape is the mismatch which is to be removed.

Figure 8:
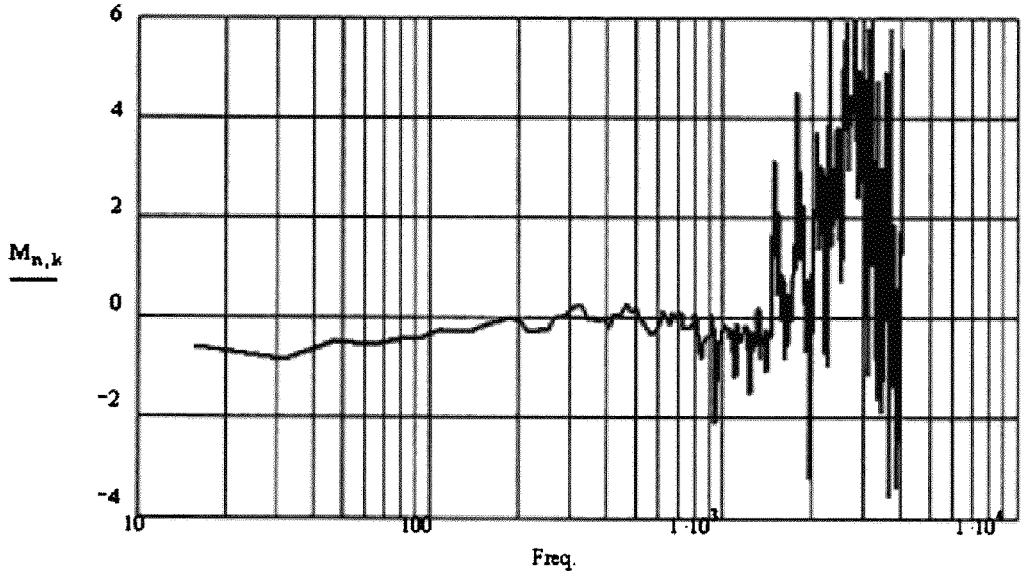
FIG. 8 shows the signal $M_{n,k}$ after minimum tracking.
Figure 9:
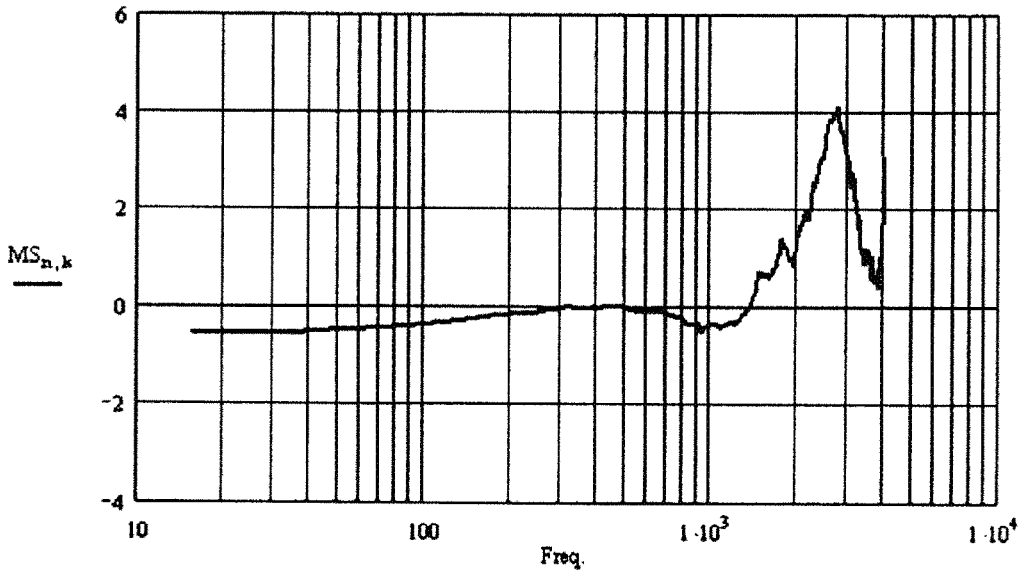
FIG. 9 is a plot of the output signal $MS_{n,k}$ after frequency smoothing.

FIG. 8 shows the signal $M_{n,k}$ after minimum tracking. Some reduction in the variation is already evident at this stage of the automatic matching process. FIG. 9 is a plot of the output signal $MS_{n,k}$ after frequency smoothing. As can be seen, this signal is very accurate and provides an excellent matching result.

Figure 4:
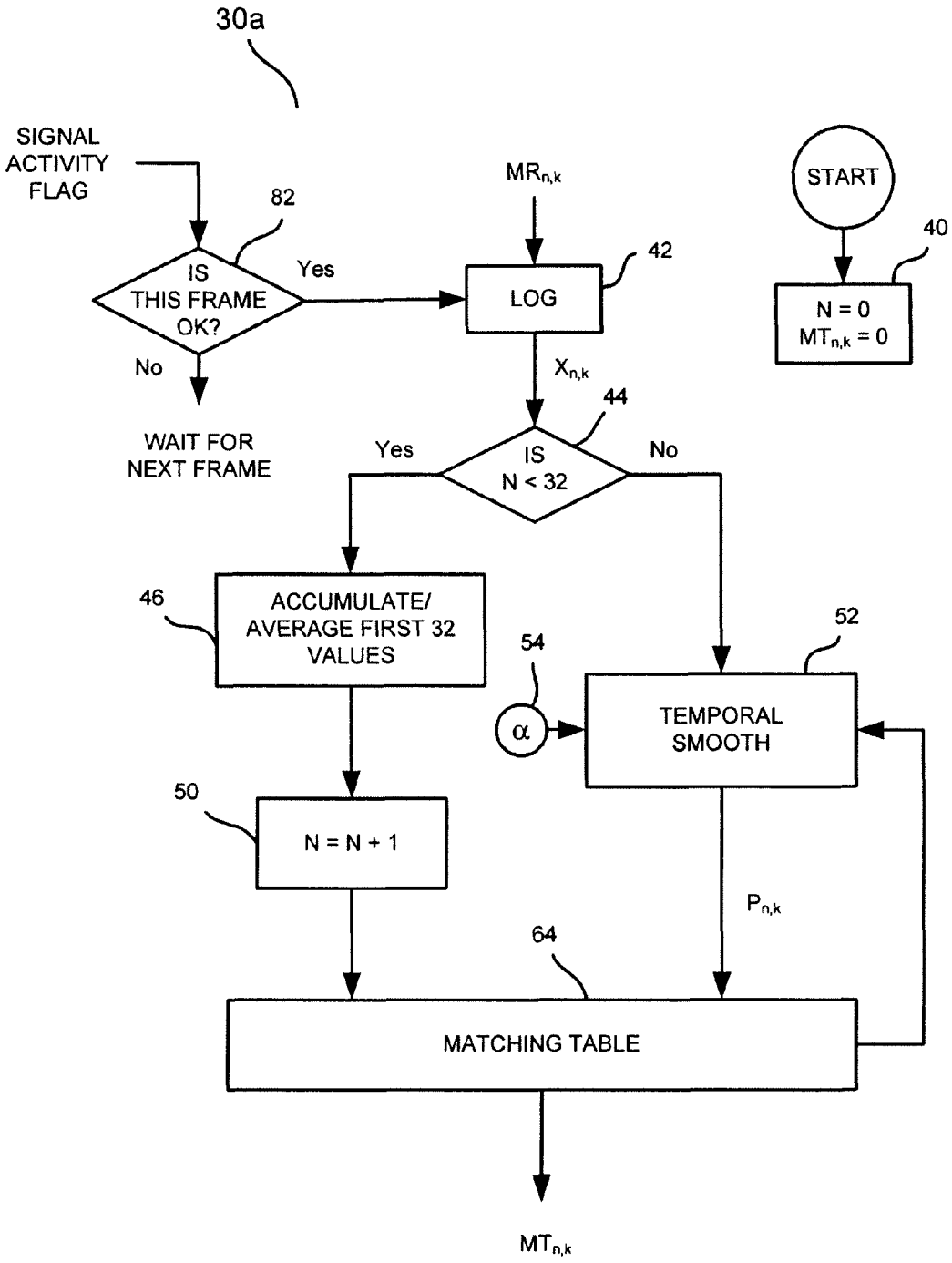
FIG. 4 is an alternative embodiment for the processing section 30*a* of FIG. 2.

Now a second exemplary embodiment will be discussed. Often in signal processing applications certain functions are required for purposes other than for sensor signal matching, and one such function is a signal activity detector (SAD). Signal activity detectors, such as VADs and NADs , are commonly needed for spectral subtraction and other noise reduction processing. Where available, the outputs from such SADs can be used in the automatic matching circuit described herein without having to provide dedicated circuits to achieve this functionality. FIG. 4 shows an alternative embodiment for the processing section 30*a* (FIG. 2). As in FIG. 2, FIG. 4 shows the alternative processing for one bin, and this processing is repeated for every bin of every frame when in operation. The circuit of FIG. 4 thus provides the signal activity detection signal, in lieu of some of the procedures of block 26 of FIG. 1. When this signal is available to indicate usable frames of data for matching purposes, then the structure of FIG.4 can be used. This structure is simplified over that of the first exemplary embodiment FIG. 2, and provides some savings in calculations, code complexity and power consumption.

Where in FIG. 4 process steps provide the same function as in FIG. 2, they are labeled with the same numbers and will not be described again. Also, signals that are the same are labeled with the same name.

As shown in FIG. 4, the signal activity flag is supplied to test step 82 where signal activity detection step 26 has determined whether the current frame of data is usable or unusable. If not usable, then the current frame is ignored and any values stored in the matching process are simply held until the next usable frame is allowed to change them. This has the effect of assuring that the start-up processes of steps 44, 46 and 50 are only performed on usable frames, and the assumption that the first Q frames are all usable, as is made in the embodiment of FIG. 2, is no longer used. As in the FIG. 2 embodiment, here Q is also selected to be 32 for consistency, but this not by way of limitation. After the first Q usable frames, the matching table in step 64 is initialized to the set of averaged values determined by the start-up steps. After the first Q usable frames of data, steering test step 44 sends the log magnitude ratio signal X k to the temporal smooth step 52, whose operation was described with respect to FIG. 2 and will not be repeated here. It is clear that the ability to receive and use the signal activity flag from outside the automatic matching process itself eliminates the need for the signal test step 48 as well as the minimum tracking step 62 of FIG. 2. Thus, in the FIG. 4 embodiment, the output $P_{n,k}$ from temporal smooth step 52 is provided directly to matching table step 64 as a set of log domain signal matching correction values. The values stored in the matching table 64, as before, are then provided as input to the remainder of the automatic matching process shown in FIG. 3.

Figure 5:
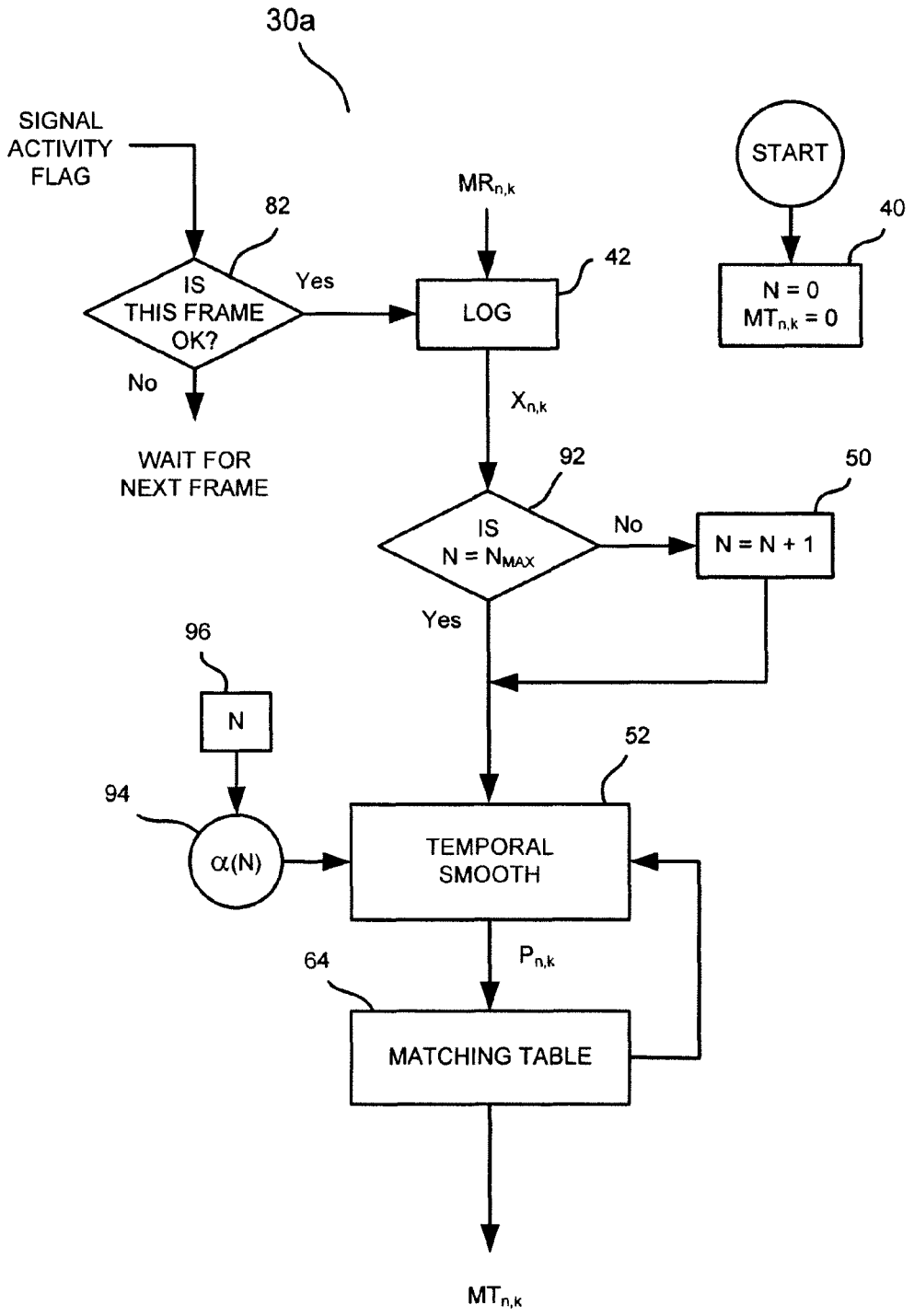
FIG. 5 is an example embodiment in which the separate start-up/initialization process is removed and replaced by a frame count dependent temporal smoothing parameter.

FIG. 5 shows an example embodiment where the separate start-up/initialization process is removed and replaced by a frame count dependent temporal smoothing parameter. In this embodiment, temporal smoothing is performed at a variable rate, being relatively fast immediately after start-up and slowing with time until a minimum speed smoothing is reached at frame count $N_{MAX}$. As compared with the embodiment FIG. 4, the functions of steps 40, 42, 52, 64 and 82 are unchanged. The steps 56 and 62 are removed as compared with the process of FIG. 2. Where the FIG. 5 embodiment differs from the FIG. 4 embodiment is in the removal of step 46, and in the addition of new steps 92, 94 and 96. For usable frames of data, a test is made of the frame count variable N to determine if it has exceeded a pre-determined maximum count $N_{MAX}$. If it has not exceeded $N_{MAX}$, then N is incremented for each frame meeting this condition by increment counter step 50. $N_{MAX}$ may be much larger than Q, with a value of 100 to 200 being typical. After this maximum count is reached, further incrementing of N may cease.

The frame count is used at step 96 to modify the value of $\alpha(N)$ in accordance with the frame count at step 94. Values of $\alpha(N)$ can be pre-determined and stored in a table, to be recalled as needed, or can be calculated in real-time according to a pre-determined equation. In general, however, the value of $\alpha(N)$ will start relatively large and decrease toward a minimum value as the frame count increases. After N reaches $N_{MAX}$, then the modification of $\alpha(N)$ stops and a minimum value for $\alpha(N)$ is used thereafter. In so doing, the temporal smooth step 52 rapidly, but with less accuracy, filters the log ratio data $X_{n,k}$ at the start of operation, but then the speed of filtering (the lowpass filter bandwidth) is reduced and the accuracy of the matching result increases over time. This process allows the matching table stored in matching table step 64 to quickly acquire the matching condition and then to proceed to refine the quality of the matching. The result is that the matching process starts quickly without a separate start-up process. The output signal from this section 30*a* consists of the correction values stored in matching table step 64 and is the signal $MT_{n,k}$ that is the input signal to the remainder section of the matching process shown in FIG. 3.

Although the frame-to-frame values for $\alpha(N)$ may follow any characteristic desired by the designer, one useful equation for generating $\alpha(N)$ in real-time is $$\alpha(N) = \varepsilon \cdot \frac{(N_{MAX} - N)}{N_{MAX}} + \alpha_{MIN} \tag{4}$$

where $\epsilon$ is a speed parameter and $\alpha_{MIN}$ is the final value reached for $\alpha$. For example, $\epsilon$ may be about 0.45 and $\alpha_{MIN}$ may be about 0.05 while $N_{MAX}$ may be 200. Of course, many other equations or sequence of values for determining $\alpha(N)$ are applicable, and the use of any one is contemplated.

An alternate application of the example system shown in FIG. 2 and FIG. 3 can use the phase difference between sensor signals as the input MR, omitting the log/antilog steps 42 and 74. Thus it will be appreciated that characteristics of the input signals, or of signals derived therefrom, different from magnitudes can be matched as described herein. An analogous approach can be used to match the phases of sensor signals, thus forming correction factors for each band and providing corresponding matching table values for phase matching of sensor signals. In a phase matching application, the phase difference between two or more signals is to be minimized or eliminated. In that case, a ratio/difference circuit (not shown) analogous to circuits 28, 108 operates as a subtractor (that is, difference circuit), as compared with the magnitude matching described above, in which circuits 28 and 108 operate as a division block (that is, ratio circuits). Such a difference circuit would make a determination of the difference, and provide an adjustment value based thereon. Similarly, rather than use a multiplicative correction (multiply by the ratio if the signals) adjustment value, for phase matching a correction value or factor can be applied as an additive or subtractive process, commensurate with a phase difference determined at the beginning of the process, at the Ratio/Difference circuit 108. More generally, when the signal mismatch is due to an additive difference between the signals, as in the case of a phase mismatch, then the difference is taken, a correction factor or value determined and the correction is applied by addition or subtraction (depending upon the "sign" of the correction). When a gain or sensitivity (multiplicative) difference is to be corrected, the ratio is taken, a correction value is determined and the correction is applied multiplicatively.

Although disclosed with separate calculations for each bin frequency, the bin frequencies could first be combined into sub-bands (e.g. Bark, Mel or ERB bands) before calculating the matching table. Since there are fewer sub-bands, this modification would reduce compute power requirements. After calculation of the matching values, the sub-bands would be expanded back to the original frequency sampling resolution before being applied to the sensor signal(s).

The frequency smoothing is optional or can be implemented with any of numerous methods including convolution, exponential filtering, IIR or FIR techniques etc.

Although disclosed using a single band limited input signal, the arrangements disclosed herein are also applicable to multi-band operation where several simultaneous separated, adjacent or overlapping bands are used, each with one of the inventive signal matching processes applied. The "SAD" control signal would be similarly multi-banded. Such a system is applicable to multi-band noise reductions systems, like multi-band spectral subtraction.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. A method for matching first and second signals in a signal processing system, the method comprising:

converting, over a selected frequency band, the first and second signals into the frequency domain such that frequency components of the first and second signals are assigned to at least one associated frequency band;

generating a scaling ratio associated with each frequency band; and for at least one of the two signals, or at least a third signal derived from at least one of the two signals, scaling frequency components associated with each frequency band by the scaling ratio associated with that frequency band, said scaling operable to compensate for intrinsic matching imperfections in the signal processing system, wherein said generating comprises determining, during a non-startup period, for a signal ratio of the first and second signals for each frequency band, the usability of each such signal ratio, and using a signal ratio in a calculation of a scaling ratio if it is determined to be usable, and wherein said determining the usability comprises ascertaining that the signal ratio is within minimum and maximum limits of tolerance values from a previous signal ratio and is the minimum of at least two signal ratios.

2. The method of claim 1, wherein said generating includes, during a startup period, averaging a Q number of signal ratios of the first and second signals for each frequency band and designating the average as a scaling ratio of that frequency bin.

3. The method of claim 1, wherein said minimum and maximum limits are indicative of a noise-only condition.

4. The method of claim 1, wherein said usability determination includes receiving an indication from a signal activity detector (SAD).

5. The method of claim 4, wherein the SAD is a noise activity detector (NAD).

6. The method of claim 4, wherein the SAD is a voice activity detector (VAD).

7. The method of claim 1, further comprising temporally smoothing signal ratios.

8. The method of claim 1, further comprising frequency smoothing the scaling ratios.

9. The method of claim 1, wherein generating a scaling ratio is conducted in the logarithm domain.

10. The method of claim 1, wherein generating a scaling ratio is conducted in the linear domain.

11. The method of claim 1, further comprising temporally smoothing scaling ratios in the logarithm domain by applying a filter to logarithmic representations of scaling ratios or to logarithmic representations of values that are functions of scaling ratios.

12. An apparatus for matching first and second signals in a signal processing system, the apparatus comprising:

means for converting, over a selected frequency band, the first and second signals into the frequency domain such that frequency components of the first and second signals are assigned to associated frequency bands;

means for generating a scaling ratio associated with each frequency band; and means for scaling frequency components associated with each frequency band by the scaling ratio associated with that frequency band for at least one of the two signals, or at least a third signal derived from at least one of the two signals, said scaling operable to compensate for intrinsic matching imperfections in the signal processing system, wherein said means for generating is operable to determine, during a non-startup period, a signal ratio of the first and second signals for each frequency band, determine the usability of each signal ratio, and use a signal ratio in a calculation of a scaling ratio if it is determined to be usable, said usability determination comprising ascertaining that the signal ratio is within minimum and maximum limits and is the minimum of at least two signal ratios.

13. The apparatus of claim 12, wherein said generating a scaling ratio includes, during a startup period, averaging a Q number of signal ratios of the first and second signals for each frequency band and designating the average as a scaling ratio of that frequency band.

14. The apparatus of claim 12, wherein said minimum and maximum limits are indicative of a noise-only condition.

15. The apparatus of claim 12, wherein said usability determination includes receiving an indication from a signal activity detector (SAD).

16. The apparatus of claim 15, wherein the SAD is a noise activity detector (NAD).

17. The apparatus of claim 15, wherein the SAD is a voice activity detector (VAD).

18. The apparatus of claim 12, further comprising means for temporally smoothing signal ratios.

19. The apparatus of claim 12, further comprising means for frequency smoothing the scaling ratios.

20. The apparatus of claim 12, wherein generating a scaling ratio is conducted in the logarithm domain.

21. The apparatus of claim 12, wherein generating a scaling ratio is conducted in the linear domain.

22. The method of claim 12, further comprising temporally smoothing scaling ratios in the logarithm domain by applying a filter to logarithmic representations of scaling ratios or to logarithmic representations of values that are functions of scaling ratios.

23. A non-transitory program storage device readable by a machine, embodying a program of instructions executable by the machine to perform a method for matching first and second signals in a signal processing system, the method comprising:

converting, over a selected frequency band, the first and second signals into the frequency domain such that frequency components of the first and second signals are assigned to associated frequency bands;

generating a scaling ratio associated with each frequency band; and for at least one of the two signals, or at least a third signal derived from at least one of the two signals, scaling frequency components associated with each frequency band by the scaling ratio associated with that frequency band, said scaling operable to compensate for intrinsic matching imperfections in the signal processing system, wherein said generating comprises determining, during a non-startup period, a signal ratio of the first and second signals for each frequency band, determining the usability of each signal ratio, and using a signal ratio in a calculation of a scaling ratio if it is determined to be usable, and wherein said determining the usability comprises ascertaining that the signal ratio is within minimum and maximum limits and is the minimum of at least two signal ratios.

24. The device of claim 23, wherein said generating includes, during a startup period, averaging a Q number of signal ratios of the first and second signals for each frequency band and designating the average as a scaling ratio of that frequency band.

25. The device of claim 23, wherein said minimum and maximum limits are indicative of a noise-only condition.

26. The device of claim 23, wherein said usability determination includes receiving an indication from a signal activity detector (SAD).

27. The device of claim 26, wherein the SAD is a noise activity detector (NAD).

28. The device of claim 26, wherein the SAD is a voice activity detector (VAD).

29. The device of claim 23, further comprising temporally smoothing signal ratios determined during said startup period.

30. The device of claim 23, further comprising frequency smoothing the scaling ratios.

31. The device of claim 23, wherein generating a scaling ratio is conducted in the logarithm domain.

32. The device of claim 23, wherein generating a scaling ratio is conducted in the linear domain.

33. The method of claim 23, further comprising temporally smoothing scaling ratios in the logarithm domain by applying a filter to logarithmic representations of scaling ratios or to logarithmic representations of values that are functions of scaling ratios.

34. A system for matching a characteristic difference associated with first and second input signals in a signal processing system, comprising:

a circuit for determining the characteristic difference;

a circuit for generating an adjustment value based on the characteristic difference;

a circuit for determining when the adjustment value is a usable adjustment value by ascertaining a ratio of the first and second input signals is within minimum and maximum limits of tolerance values from a previous ratio of the first and second input signals and is the minimum of at least two ratios of the first and second input signals; and a circuit for adjusting at least one of the first or second input signals, or at least a third signal derived from at least one of the first or second input signals, as a function of the usable adjustment value, said adjusting operable to compensate for intrinsic matching imperfections in the signal processing system.

35. The system of claim 34, wherein the characteristic difference is phase.

36. The system of claim 35, wherein the adjustment value is an additive or subtractive value.

37. The system of claim 34, wherein the characteristic difference is magnitude.

38. The system of claim 37, wherein the adjustment value is multiplicative.

39. The system of claim 34, wherein the circuit for determining when the adjustment value is a usable adjustment value is a SAD (sound activity detector).

40. The system of claim 34, wherein the determination of usability is a function of a predetermined start-up period, and is different during the start-up period from a non-start up period.

41. The system of claim 34, wherein the system operates in the frequency domain.

42. The system of claim 34, wherein the system operates in the linear domain.

43. The system of claim 34, wherein the system operates in the logarithmic domain.

44. A method for matching first and second signals in a signal processing system, the method comprising:

converting, over a selected frequency band, the first and second signals into the frequency domain such that frequency components of the first and second signals are assigned to associated frequency bands;

generating a correction factor associated with each frequency band; and for at least one of the two signals, or at least a third signal derived from at least one of the two signals, correcting at least one frequency component associated with each frequency band by arithmetically combining said correction factor with said signal associated with each such frequency band, said correcting operable to compensate for intrinsic matching imperfections in the signal processing system, wherein said generating comprises determining, for a signal difference of the first and second signals for each frequency band, the usability of each signal difference, and using such signal difference in the calculation of the correction factor if it is determined to be usable, and wherein said determining the usability comprises ascertaining that the signal difference is within minimum and maximum limits of tolerance values from a previous signal difference and is the minimum of at least two signal differences.

* * * * *